US008967765B2

(12) United States Patent
Miyazawa

(10) Patent No.: US 8,967,765 B2
(45) Date of Patent: Mar. 3, 2015

(54) LIQUID EJECTING APPARATUS

(71) Applicant: Seiko Epson Corporation, Tokyo (JP)

(72) Inventor: Tomoyuki Miyazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 13/779,259

(22) Filed: Feb. 27, 2013

(65) Prior Publication Data

US 2013/0222473 A1 Aug. 29, 2013

(30) Foreign Application Priority Data

Feb. 29, 2012 (JP) ..... 2012-044504

(51) Int. Cl.
*B41J 2/165* (2006.01)

(52) U.S. Cl.
CPC ..... *B41J 2/16544* (2013.01); *B41J 2/16547* (2013.01)
USPC ..... 347/32; 347/29

(58) Field of Classification Search
USPC ..... 347/22, 29–39
See application file for complete search history.

(56) References Cited

U.S. PATENT DOCUMENTS

| | | | | |
|---|---|---|---|---|
| 6,769,758 | B2 * | 8/2004 | Wanibuchi et al. | 347/33 |
| 7,654,634 | B2 * | 2/2010 | Hiruma | 347/29 |
| 2008/0291240 | A1 * | 11/2008 | Ohsako et al. | 347/33 |
| 2009/0289992 | A1 * | 11/2009 | Kawabata | 347/33 |

FOREIGN PATENT DOCUMENTS

| | | |
|---|---|---|
| JP | 2005-125759 | 5/2005 |
| JP | 2010-052382 | 3/2010 |

* cited by examiner

*Primary Examiner* — Stephen Meier
*Assistant Examiner* — Renee I Wilson
(74) *Attorney, Agent, or Firm* — Workman Nydegger

(57) ABSTRACT

A liquid ejecting apparatus includes an ejecting head that has a nozzle for ejecting liquid onto a medium, a carriage that holds the ejecting head and can be moved in a predetermined direction, a maintenance member that can be moved up and down with respect to a nozzle formation surface where the nozzle is formed in the ejecting head, and performs maintenance on the nozzle formation surface, a lock member that can be moved up and down with respect to the carriage and fixes a position of the carriage, and a movement member that moves the lock member and the maintenance member such that a lifting amount of the lock member is different from a lifting amount of the maintenance member.

6 Claims, 6 Drawing Sheets

LIQUID EJECTING APPARATUS

BACKGROUND

1. Technical Field

The present invention relates to a liquid ejecting apparatus.

2. Related Art

In the related art, as a liquid ejecting apparatus, an ink jet type recording apparatus is known in which ink (liquid) is ejected onto a recording medium from an ejecting head (liquid ejecting head) mounted on a carriage, thereby performing a desired printing process. In this ink jet type recording apparatus, a sucking operation is performed in which ink is forced to be discharged from an ejecting nozzle by a cap member coming into contact with a nozzle forming surface of the ejecting head, so as to perform a maintenance work for maintaining ink ejecting characteristics in the ejecting head (for example, refer to JP-A-2010-52382). In this sucking operation, a position of the carriage is fixed through engagement with a lock lever.

However, in the technique in the related art, there is a problem in that a movement amount of the lock lever which locks the carriage is the same as a vertical movement amount of the cap member, and thus the movement amount of the lock lever cannot be selectively increased. Therefore, it is desirable to provide a new technique capable of making a movement amount of a maintenance member such as the cap member different from a movement amount of the lock lever.

SUMMARY

An advantage of some aspects of the invention is to provide a liquid ejecting apparatus capable of making movement amounts of a maintenance member and a lock lever different from each other.

According to an aspect of the invention, there is provided a liquid ejecting apparatus including an ejecting head that has a nozzle ejecting liquid onto a medium; a carriage that holds the ejecting head and can be moved in a predetermined direction; a maintenance member that can be moved up and down with respect to a nozzle formation surface where the nozzle is formed in the ejecting head, and performs maintenance on the nozzle formation surface; a lock member that can be moved up and down with respect to the carriage and fixes a position of the carriage; and a movement member that moves the lock member and the maintenance member such that a lifting amount of the lock member is different from a lifting amount of the maintenance member.

According to the liquid ejecting apparatus of the first aspect of the invention, since it is possible to make lifting amounts of the lock member and the maintenance member different from each other using the movement member, for example, it is possible to relatively increase a lifting amount of the lock member with respect to the maintenance member. Therefore, it is possible to increase an engagement amount between the lock member and the carriage and to thereby favorably fix a position of the carriage.

The movement member may be a lever member which is rotated with respect to a predetermined fulcrum and of which a first portion which comes into contact with the maintenance member and a second portion which comes into contact with the lock member have different distances from the fulcrum.

With this configuration, since the first portion and the second portion have different distances from the fulcrum, it is possible to make lifting amounts of the lock member and the maintenance member different from each other with a simple configuration in which the lever member is rotated.

The maintenance member may be a wiping member which sweeps away the nozzle formation surface, and the first portion of the movement member may be more distant from the fulcrum than the second portion thereof.

With this configuration, the first portion forming a contact portion with the wiping member becomes distant from the fulcrum, and thus a lifting amount of the wiping member can be made to be more than that of the lock member.

The maintenance member may be a cap member which sweeps away the nozzle formation surface, and the second portion of the movement member may be more distant from the fulcrum than the first portion thereof.

With this configuration, the second portion forming a contact portion with the lock member is distant from the fulcrum, and thus a lifting amount of the lock member can be made to be more than that of the cap member.

The movement member may be a composite gear which is rotated with respect to a predetermined rotation axis and of which a first gear which comes into contact with the maintenance member and a second gear which comes into contact with the lock member have different shapes.

With this configuration, since the first gear and the second gear have different outer diameters, it is possible to make lifting amounts of the lock member and the maintenance member different with a simple configuration in which the composite gear is rotated.

The maintenance member may be a wiping member which sweeps away the nozzle formation surface, and the first gear of the composite gear may have an outer diameter larger than the second gear thereof.

With this configuration, the wiping member comes into contact with the first gear having the larger outer diameter and thus a lifting amount of the wiping member can be made to be more than that of the lock member.

The maintenance member may be a cap member which comes into contact with the nozzle formation surface, and the second gear of the composite gear may have an outer diameter larger than the first gear thereof.

With this configuration, the lock member comes into contact with the second gear having the larger outer diameter and thus a lifting amount of the lock member can be made to be more than that of the wiping member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In addition, in the respective drawings, the respective members have different scales such that the respective members with different sizes can be recognized. Further, in the present embodiment, an ink jet type printer (hereinafter, referred to as a printer) represented by an image recording apparatus which is a form of the liquid ejecting apparatus will be described as an example.

First Embodiment

Figure 1:
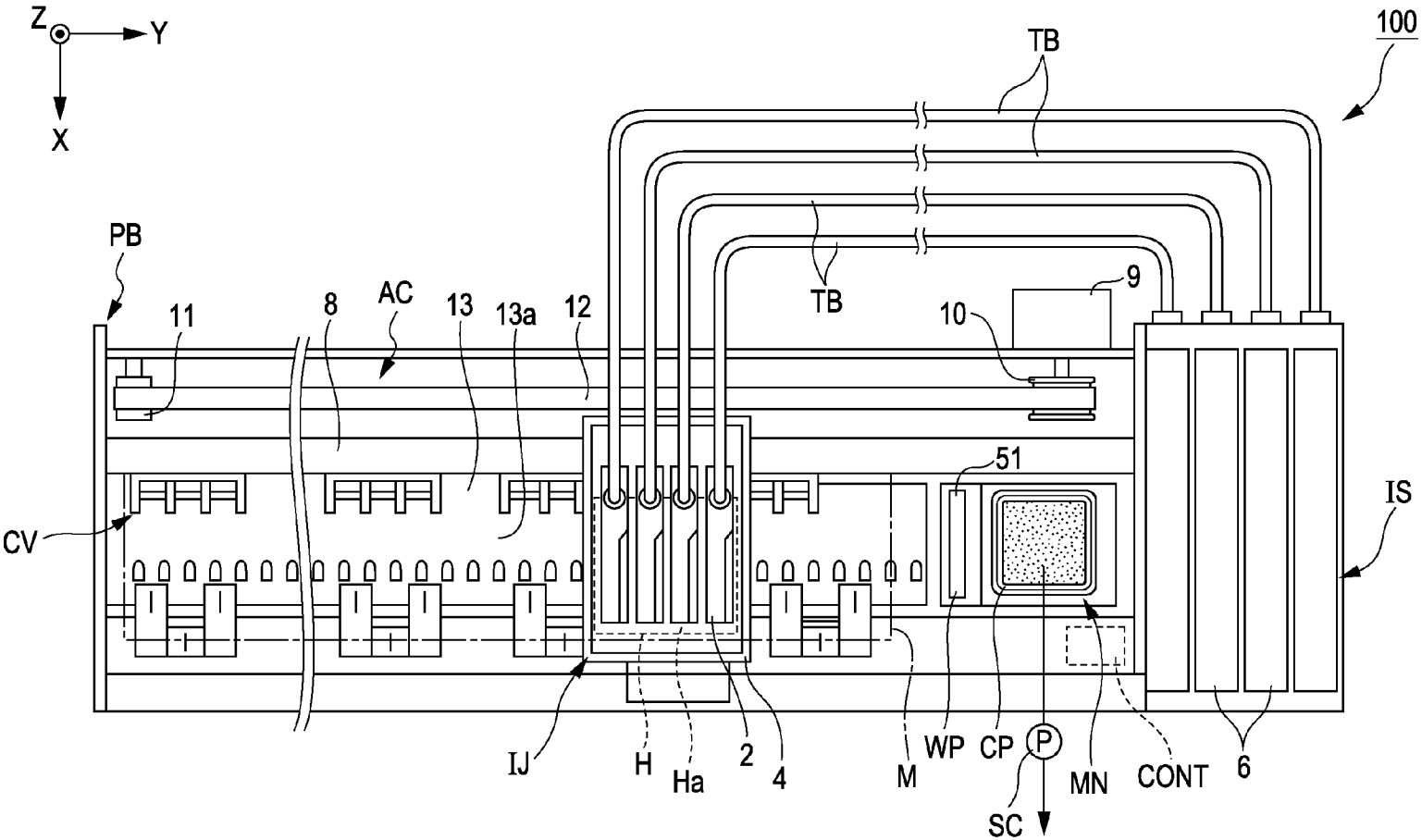
FIG. 1 is a diagram illustrating a schematic configuration of a printer according to a first embodiment.

FIG. 1 is a diagram illustrating a schematic configuration of a printer 100 according to the present embodiment.

The printer 100 shown in FIG. 1 is an apparatus which transports a medium M with a sheet shape such as, for example, a paper sheet, or a plastic sheet and performs a printing process. The printer 100 includes a casing PB, an ink jet mechanism IJ which ejects ink on the medium M, an ink supply mechanism IS which supplies ink to the ink jet mechanism IJ, a transport mechanism CV which transports the medium M, a maintenance mechanism MN which performs a maintenance operation of the ink jet mechanism IJ, and a control device CONT which controls the respective mechanisms.

Hereinafter, an XYZ orthogonal coordinate system is set, and a positional relationship of each constituent element will be described by appropriately referring to the XYZ orthogonal coordinate system. In the present embodiment, for example, a transport direction of the medium M is indicated by an X direction, a direction perpendicular to the X direction in a transport surface of the medium M is indicated by a Y direction, and a direction perpendicular to the plane including the X axis and the Y axis is indicated by a Z direction. In addition, a rotation direction about the X axis is set as a θX direction, a rotation direction about the Y axis is set as a θY direction, and a rotation direction about the Z axis is set as a θZ direction.

The casing PB is formed so as to be long, for example, in the Y direction. In the casing PB, the ink jet mechanism IJ, the ink supply mechanism IS, the transport mechanism CV, the maintenance mechanism MN, and the control device CONT are installed. For example, a platen 13 is installed in the casing PB. The platen 13 is a support member which supports the medium M. The platen 13 is disposed, for example, at a central part of the casing PB in the X direction. The platen 13 has a support surface 13*a* facing in the +Z direction. The support surface 13*a* is used as a support surface which supports the medium M.

The transport mechanism CV has, for example, a transport roller, a motor which drives the transport roller, and the like. The transport mechanism CV transports the medium M, for example, from the −X direction of the casing PB to inside of the casing PB, and discharges the medium M from the +X direction of the casing PB to outside of the casing PB. The transport mechanism CV transports the medium M such that the medium M passes on the platen 13 inside the casing PB. A transport timing or an transport amount of the transport mechanism CV is controlled, for example, by the control device CONT.

The ink jet mechanism IJ includes a head H which ejects ink, and a head movement mechanism AC which holds and moves the head H. The head H ejects ink toward the medium M forwarded onto the platen 13. The head H has an ejecting surface (nozzle forming surface) Ha which ejects ink. The ejecting surface Ha faces, for example, in the −Z direction, and is disposed so as to be opposite to, for example, the support surface 13*a* of the platen 13.

The head movement mechanism AC has a carriage 4. The head H is fixed to the carriage 4. The carriage 4 comes into contact with a guide shaft 8 which is suspended in the longitudinal direction (X direction) of the casing PB. The head H and the carriage 4 are disposed, for example, in the +Z direction of the platen 13.

The head movement mechanism AC includes not only the carriage 4, but also, for example, a pulse motor 9, a driving pulley 10 which is rotatably driven so as to be by the pulse motor 9, a free-rolling pulley 11 which is provided on an opposite side to the driving pulley 10 in the width direction of the casing PB, and a timing belt 12 which is hung between the driving pulley 10 and the free-rolling pulley 11 and is connected to the carriage 4.

The carriage 4 is connected to the timing belt 12. The carriage 4 is provided so as to move in the Y direction when the timing belt 12 rotates. The carriage 4 is guided by the guide shaft 8 when moving in the Y direction.

The ink supply mechanism IS supplies ink to the head H. The ink supply mechanism IS accommodates, for example, a plurality of ink cartridges 6. The printer 100 of the present embodiment has a configuration (an off-carriage type) in which the ink cartridges 6 are accommodated at a position different from that of the head H. The ink supply mechanism IS has, for example, supply tubes TB which connects the head H to the ink cartridges 6. The ink supply mechanism IS includes a pump mechanism (not shown) which supplies ink stored in the ink cartridges 6 to the head H via the supply tubes TB. The maintenance mechanism MN is disposed at a home position of the head H. The home position is set, for example, in a region deviated from a region where printing is performed on the medium M. In the present embodiment, the home position is set on the +Y side of the platen 13, for example. The home position is a place where the head H waits, for example, when the printer 100 is powered off, when recording is not performed for a long time, and the like.

The maintenance mechanism MN includes, for example, a capping mechanism CP which covers the ejecting surface Ha of the head H, a wiping mechanism WP which sweeps away the ejecting surface Ha, and the like. The capping mechanism CP is connected to a sucking mechanism SC such as, for example, a sucking pump. The capping mechanism CP covers, for example, the ejecting surface Ha, and can suck a space on the ejecting surface Ha with the sucking mechanism SC. Ink waste discharged to the maintenance mechanism MN side from the head H is recovered by, for example, a liquid waste recovering mechanism (not shown).

Figure 2:
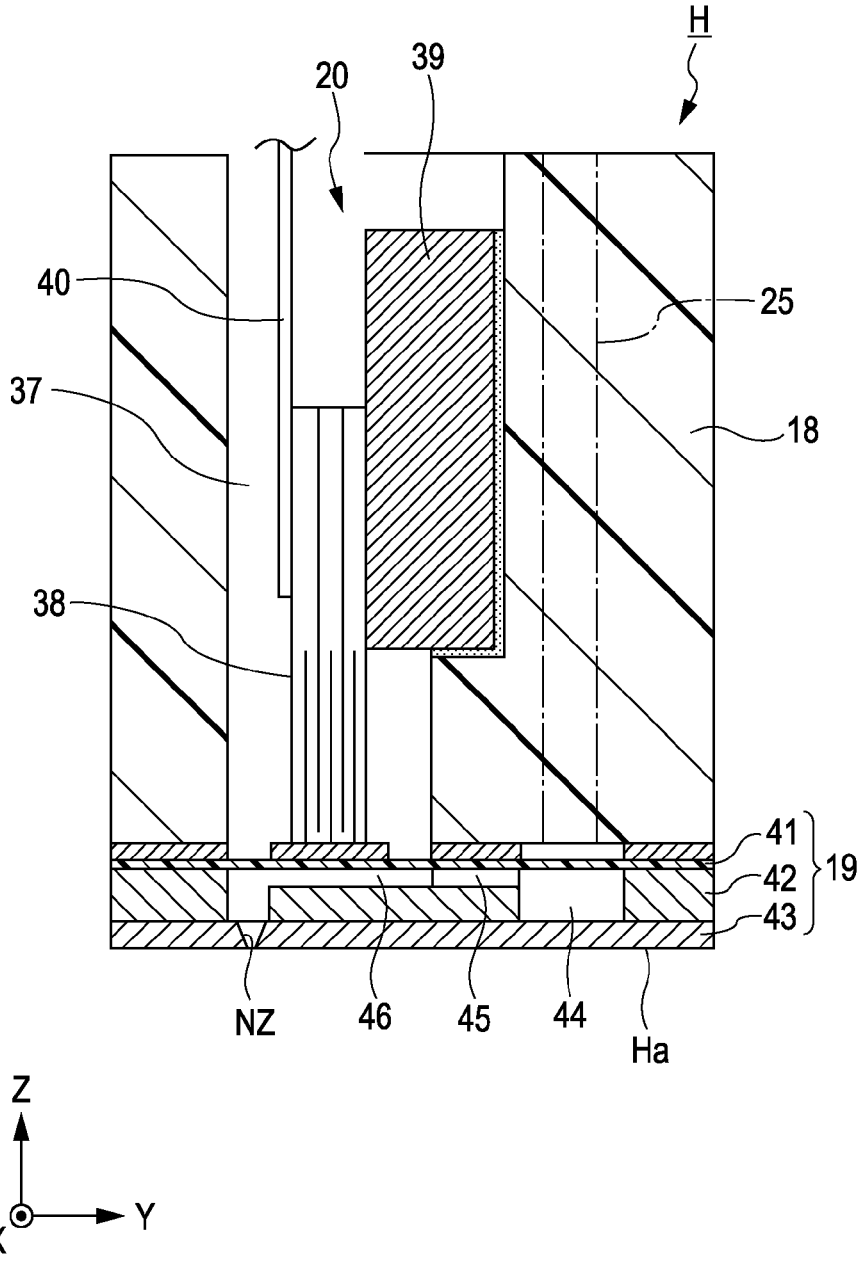
FIG. 2 is a cross-sectional view of main portions illustrating a configuration of a head.

FIG. 2 is a main portion cross-sectional view illustrating a configuration of the head H. As shown in FIG. 2, the head H includes a head case 18, a fluid channel unit 19, and an actuator unit 20.

The head case 18 is formed using a synthetic resin, or the like. The head case 18 is formed in a box shape so as to have, for example, a hollow portion. The head case 18 is equipped with a guiding needle unit (not shown) via a packing on the upper side thereof. The fluid channel unit 19 is adhered to the lower end surface of the head case 18. The actuator unit 20 is accommodated in the hollow portion 37 formed inside the head case 18.

A case fluid channel 25 is provided so as to penetrate in the height direction inside the head case 18. The upper end of the case fluid channel 25 communicates with an ink guiding channel of the ink cartridge side via a packing and the guiding needle unit (not shown). The lower end of the case fluid channel 25 communicates with a common ink room 44 in the fluid channel unit 19. For this reason, ink which is guided from the ink cartridge side is supplied to the common ink room 44 side through the case fluid channel 25.

The actuator unit 20 includes, for example, a plurality of piezoelectric vibrators 38 which are disposed in a comb shape, a fixing plate 39 which holds the piezoelectric vibrators 38, and a flexible cable 40 which supplies a driving signal from the control device CONT to the piezoelectric vibrators 38.

The piezoelectric vibrators 38 are fixed such that lower end portions thereof in FIG. 2 protrude from the lower end surface of the fixing plate 39. As above, each of the piezoelectric vibrators 38 is installed on the fixing plate 39, in a so-called cantilever state. The fixing plate 39 which supports the respective piezoelectric vibrators 38 is made of stainless steel which is, for example, about 1 mm thick. In the fixing plate 39, for example, a surface different from the surface to which the piezoelectric vibrators 38 are fixed is adhered to a case inner wall surface which partitions the hollow portion 37.

The fluid channel unit 19 has a vibrating plate 41, a fluid channel substrate 42, and a nozzle substrate 43. The vibrating plate 41, the fluid channel substrate 42, and the nozzle substrate 43 are adhered to each other in a laminated state. The fluid channel unit 19 forms a series of ink fluid channels (liquid fluid channels) from the common ink room 44 to a nozzle NZ via an ink supply hole 45 and a pressure room 46. The pressure room 46 is formed such that a direction perpendicular to an arrangement direction (nozzle string direction) of the nozzles NZ is a longitudinal direction.

The common ink room 44 is connected to the case fluid channel 25. The common ink room 44 is a room to which ink from the cartridge side is guided. In addition, the common ink room 44 is connected to the ink supply hole 45. The ink guided to the common ink room 44 is distributed to each pressure room 46 via the ink supply hole 45.

The nozzle substrate 43 is disposed at a bottom of the fluid channel unit 19. A plurality of nozzles NZ are formed in the nozzle substrate 43 at a pitch (for example, 180 dpi) corresponding to a dot formation density of an image or the like formed on the medium M. As the nozzle substrate 43, a plate material made of metal such as, for example, stainless steel, is used.

Figure 3A:
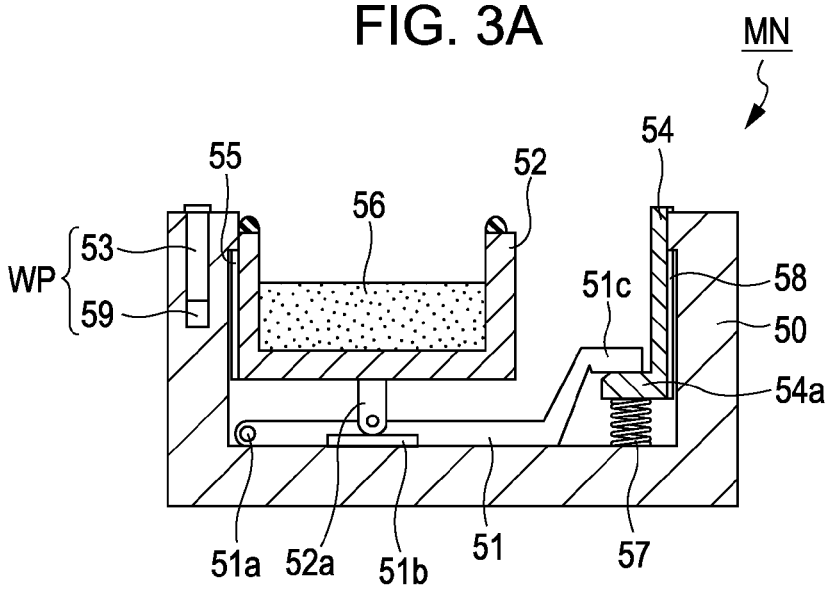
FIGS. 3A and 3B are cross-sectional views illustrating a configuration of a maintenance mechanism according to the first embodiment.
Figure 3B:
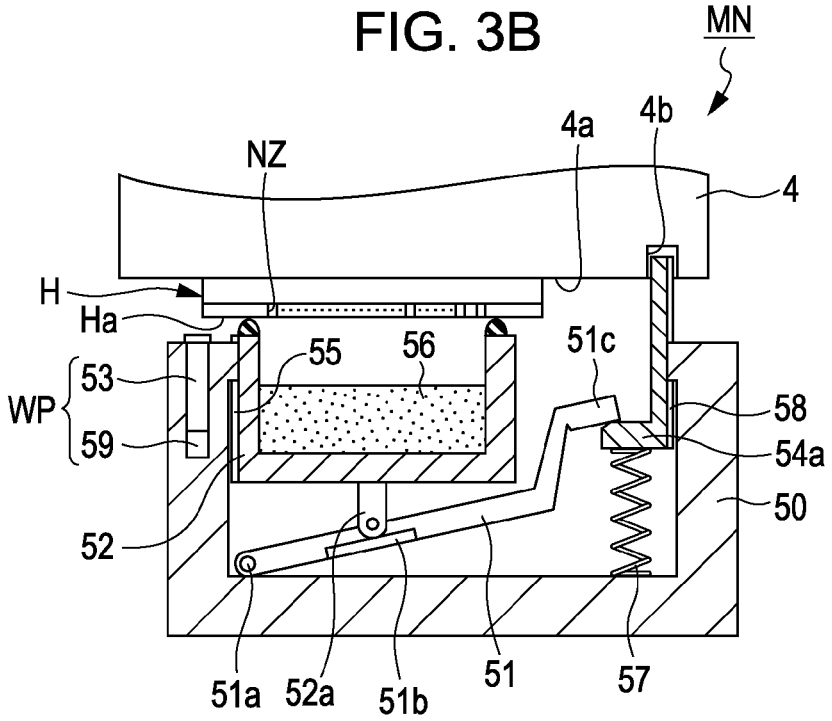

FIGS. 3A and 3B are cross-sectional views illustrating a configuration of the maintenance mechanism MN according to the present embodiment, where FIG. 3A shows a state in which a cap member moves downward, and FIG. 3B shows a state in which the cap member moves upward. As shown in FIGS. 3A and 3B, the maintenance mechanism MN includes a main body portion 50, a lever member (movement member) 51 which is installed so as to be rotatably moved with respect to the main body portion 50, a cap member 52, the wiping mechanism WP having a wiping member 53, and a lock member 54 which fixes a position of the carriage 4. In addition, the cap member 52 and the wiping member 53 constitute a maintenance member of the invention.

The lever member 51 is installed in the main body portion 50 in a state of being rotatably moved by a driving member (not shown) via a fulcrum 51*a* provided at one end thereof. A cap contact portion (a first portion) 51*b* which comes into contact with and holds the cap member 52 is provided approximately in the center of the lever member 51. A lock contact portion (a second portion) 51*c* is provided at the other end of the lever member 51 which is bent and comes into contact with the lock member 54. Specifically, the lever member 51 is rotatably moved with respect to the fulcrum 51*a* so as to lift up the lock contact portion 51*c* side as shown in FIG. 3B.

The lock contact portion 51*c* is provided at a location more distant from the fulcrum 51*a* than the cap contact portion 51*b*. With this configuration, when the lever member 51 is rotatably moved with respect to the fulcrum 51*a*, an upward movement amount in the lock contact portion 51*c* which is distant from the fulcrum 51*a* can be made to be larger than an upward movement amount in the cap contact portion 51*b*. In other words, the lever member 51 realizes a configuration in which movement amounts (lifting amounts) in the cap member 52 and the lock member 54 are different from each other.

In addition, the lock contact portion 51*c* is located at a position more distant upward (in the Z direction) from the bottom surface 50*a* of the main body portion 50 than the fulcrum 51*a* and the cap contact portion 51*b* in a state in which the lever member 51 is installed in the main body portion 50. Thereby, the lock contact portion 51*c* can be moved upward to a higher position than the cap contact portion 51*b* when the lever member 51 is rotatably moved. Therefore, the front end part of the lock member 54 which comes into contact with and is held by the lock contact portion 51*c* is moved upward to a high position.

The cap member 52 is formed by a frame-shaped member which comes into contact with the ejecting surface Ha of the head H, and can perform a sucking process in which pressure is reduced by driving the sucking mechanism SC (refer to FIG. 1) in a state of air-tightly closing the ejecting surface Ha, and thus ink is forced to be discharged from the nozzles NZ. An ink absorption body 56 which absorbs ink waste discharged from the nozzles NZ through the sucking process is provided inside the cap member 52. The cap member 52 can be moved up and down by the lever member 51 described later.

The cap member 52 is held by a cap guiding portion 55 of which one end is provided in the inner surface of the main body portion 50. The cap member 52 can be moved in a vertical direction by the cap guiding portion 55 without rattling.

The cap member 52 has a protrusion 52*a* which comes into contact with the above-described cap contact portion 51*b* of the lever member 51. The protrusion 52*a* is formed by a cylindrical member, and the cylindrical surface thereof comes into contact with the cap contact portion 51*b* formed in a plate shape. Thereby, even in a case where the lever member 51 is rotatably moved and thus a position of the cap contact portion 51*b* varies, the protrusion 52*a* maintains a state of coming into contact with the surface of the cap contact portion 51*b*.

With this configuration, when the lever member 51 is rotatably moved with respect to the fulcrum 51*a* and thereby a position of the cap contact portion 51*b* is moved upward, the protrusion 52*a* is the cap member 52 is pushed up, and, simultaneously, the cap member 52 is guided by the cap guiding portion 55 so as to be moved upward. Thereby, the cap member 52 can come into contact with the ejecting surface Ha of the head H located at the home position.

The wiping mechanism WP has the wiping member 53 which sweeps away the ejecting surface Ha, and a driving mechanism 59. The wiping member 53 is used to remove ink waste attached to the ejecting surface Ha due to the above-described sucking operation, by performing the wiping operation for sweeping away the ejecting surface Ha. The driving mechanism 59 moves up and down the wiping member 53 with respect to the upper surface of the main body portion 50. The wiping member 53 is formed by an elastic member such as, for example, an elastomer, and prevents the ejecting surface Ha from being damage. In addition, the wiping mechanism WP is provided with the driving mechanism 59 and thereby can be driven independently from a lifting operation of the capping mechanism CP and the lock member 54 which are moved up and down due to the rotatable movement operation of the lever member 51.

The lock member 54 has a bent portion 54*a* which is bent approximately in an L shape in the lower end part, and the bent portion 54*a* comes into contact with the lock contact portion 51*c* of the lever member 51. In addition, a spring member 57 is provided between a lower surface of the bent portion 54*a* and the bottom surface 50*a* of the main body portion 50. Thereby, the lock member 54 is in a state of being biased upward by the spring member 57.

The lock member 54 is held by a lock guiding portion 58 of which one end side is provided at the inner surface of the main body portion 50. The lock member 54 can be moved by the lock guiding portion 58 in the vertical direction without rattling.

With this configuration, when the lever member 51 is rotatably moved with respect to the fulcrum 51*a* such that a position of the lock contact portion 51*c* is moved upward, the lock member 54 is guided in the lock guiding portion 58 by a biasing force of the spring member 57 and is thus moved upward. When the lever member 51 is rotatably moved, as shown in FIG. 3B, the lock member 54 is inserted into a recess portion 4*b* provided in a lower surface 4*a* of the carriage 4 so as to be engaged with the carriage 4. Thereby, the carriage 4 is fixed to the capping mechanism CP held in the printer 100 (the casing PB) by the lock member 54. In the above-described way, the lock member 54 can fix a position of the carriage 4 which holds the head H located at the home position. Therefore, it is possible to remove rattling of the head H when the cap member 52 comes into contact with the ejecting surface Ha of the head H and to thereby favorably perform the above-described capping operation.

Next, an operation of the printer 100 with the above-described configuration will be described. In addition, in the following description, an operation of the capping mechanism CP which is a feature of the present specification will be described mainly.

When a job command for starting printing is input, the control device CONT drives the transport mechanism CV so as to transport the medium M, and applies a voltage to the piezoelectric vibrators 38 so as to drive the head H. Thereby, the head H ejects ink onto a predetermined position of the medium M which is transported directly thereunder by the transport mechanism CV from the nozzles NZ, thereby performing a desired printing process.

In the printer 100, the ink supply mechanism IS supplies ink to the head H from the ink cartridges 6 during the printing process. Thereby, the printer 100 can continue to perform the printing process by continuously ejecting ink onto the medium M.

In the printer 100, in order to maintain the ink ejecting characteristics of the head H, for example, when the printer 100 is initially driven or a predetermined time has elapsed, a maintenance process by the maintenance mechanism MN is performed.

The control device CONT drives the maintenance mechanism MN in accordance with maintenance timing of the head H. The control device CONT moves the carriage 4 on which the head H is mounted to an above position of the maintenance mechanism MN disposed at the home position.

The control device CONT rotatably moves the lever member 51 with respect to the fulcrum 51*a* after the ejecting surface Ha of the head H faces the cap member 52 of the capping mechanism CP. The cap contact portion 51*b* of the lever member 51 pushes up the protrusion 52*a* of the cap member 52. Thereby, the cap member 52 comes into contact with the ejecting surface Ha.

In addition, the lock contact portion 51*c* pushes up the bent portion 54*a* of the lock member 54 due to the rotatable movement operation of the lever member 51. Thereby, the lock member 54 is moved upward and is thus inserted into the recess portion 4*b* provided in the lower surface 4*a* of the carriage 4 so as to be engaged with the carriage 4. Thereby, the lock member 54 can fix a position of the carriage 4.

In the present embodiment, the lock contact portion 51*c* is provided at a location more distant from the fulcrum 51*a* than the cap contact portion 51*b*. For this reason, when the lever member 51 is rotatably moved with respect to the fulcrum 51*a*, it is possible to increase a movement amount of the lock member 54 by the lock contact portion 51*c* distant from the fulcrum as compared with that of the cap member 52 by the cap contact portion 51*b*. Therefore, the lock member 54 can be inserted into a deep position inside the recess portion 4*b* of the carriage 4 by increasing a lifting amount of the lock member 54 without increasing a lifting amount of the cap member 52. Accordingly, the lock member 54 is reliably engaged with the carriage 4, and thus it is possible to reliably hold a position of the carriage 4.

After the cap member 52 comes into contact with the ejecting surface Ha of the head H, the control device CONT drives the sucking mechanism SC (refer to FIG. 1). The space formed between the cap member 52 and the ejecting surface Ha is reduced in pressure and is in a negative pressure state. Thereby, ink can be discharged into the cap member 52 from the nozzles NZ. The ink waste discharged into the cap member 52 is absorbed by the ink absorption body 56. The cap member 52 provided with the ink absorption body 56 which has absorbed the ink waste comes into contact with the ejecting surface Ha, thereby moisturizing the nozzles NZ formed in the ejecting surface Ha.

When the sucking operation finishes, the control device CONT moves the lever member 51 downward. The cap member 52 is moved downward along the cap guiding portion 55 due to the downward movement of the lever member 51 (the cap contact portion 51*b*), and returns to the initial position shown in FIG. 3A.

In addition, the lock member 54 is moved downward along the lock guiding portion 58 due to the downward movement of the lever member 51 (the lock contact portion 51*c*) and returns to the initial position shown in FIG. 3A. At this time, the spring member 57 is pinched between the bent portion 54*a* and the main body portion 50 so as to be crushed.

As described above, according to the present embodiment, lifting amounts of the lock member 54 and the cap member 52 can be made to be different from each other by the lever member 51 so as to increase an engagement amount between the lock member 54 and the carriage 4, thereby favorably fixing a position of the carriage 4.

In addition, since, in the lever member 51, distances of the cap contact portion 51*b* and the lock contact portion 51*c* from the fulcrum 51*a* are different from each other, it is possible to make lifting amounts of the lock member 54 and the cap member 52 different from each other with a simple configuration in which the lever member 51 is rotated.

Second Embodiment

Next, the second embodiment related to the printer 100 will be described. A difference between the present embodiment and the first embodiment is a peripheral structure of the maintenance mechanism MN, and the other configurations are common. Therefore, hereinafter, only a peripheral configuration of the maintenance mechanism MN will be described, and description of the other configurations will be omitted or be made briefly. In addition, the same constituent elements and members as in the first embodiment are given the same reference numerals and are described.

Figure 4A:
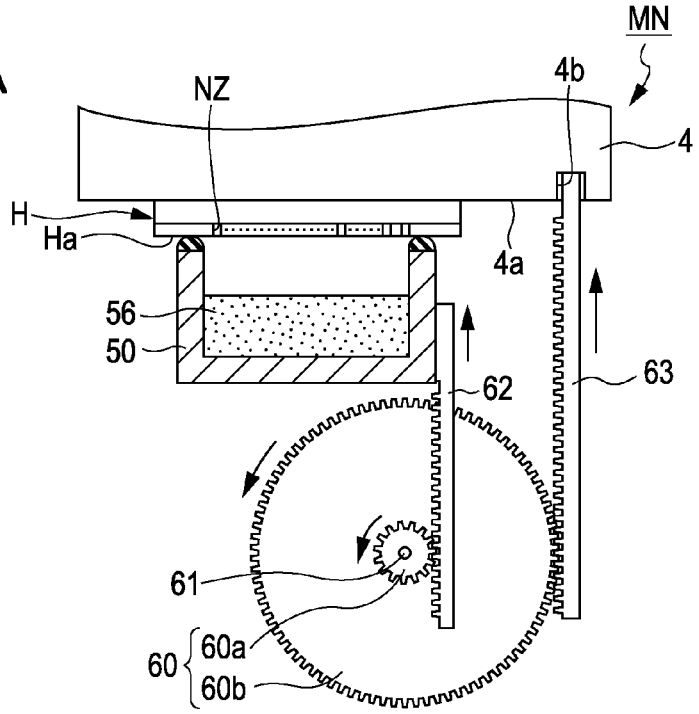
FIGS. 4A and 4B are cross-sectional views illustrating a configuration of a maintenance mechanism according to a second embodiment.
Figure 4B:
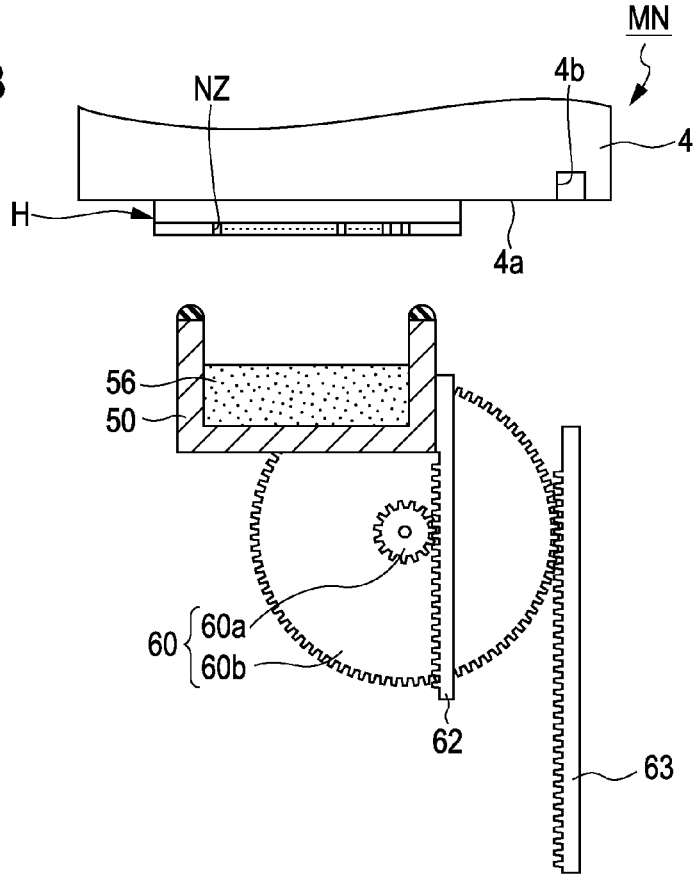

FIGS. 4A and 4B are cross-sectional views illustrating a configuration of a maintenance mechanism MN according to the present embodiment, where FIG. 4A shows a state in which a cap member is moved upward, and FIG. 4B shows a state in which the cap member is moved downward. The maintenance mechanism MN according to the present embodiment includes, as shown in FIGS. 4A and 4B, a gear portion 60 used as a movement member instead of the above-described lever member 51, a cap member 52, and a lock member 54. In addition, in FIGS. 4A and 4B, the wiping mechanism WP and the main body portion 50 are not shown.

The gear portion 60 includes a first gear 60*a* and a second gear 60*b* formed by spur gears. The first gear 60*a* and the second gear 60*b* are fixed so as to be rotated about the same axis with respect to a rotation shaft 61. The first gear 60*a* has a smaller outer diameter than the second gear 60*b*. The first gear 60*a* and the second gear 60*b* are the same module as each other. In other words, the second gear 60*b* with the larger outer diameter has more teeth than the first gear 60*a*.

The first gear 60*a* meshes with a first rack member 62. One end side of the first rack member 62 is fixed to the side surface of the cap member 52. The first gear 60*a* is rotated in a predetermined direction (for example, a counterclockwise direction in FIG. 4A) so as to move the first rack member 62 upward.

The second gear 60*b* meshes with a second rack member 63. The second gear 60*b* is rotated in a predetermined direction (for example, a counterclockwise direction in FIG. 4A), and thereby one end side of the second rack member 63 is inserted into the recess portion 4*b* provided in the bottom of the carriage 4 and is engaged with the carriage 4. In other words, one end part of the second rack member 63 forms a lock member 63*a*.

With this configuration, when the first gear 60*a* and the second gear 60*b* are rotated about the rotation shaft 61, the first rack member 62 and the second rack member 63 can be moved up and down. Here, since the first gear 60*a* and the second gear 60*b* have different shapes, lifting amounts of the first rack member 62 and second rack member 63 can be made to be different from each other. In other words, the number of teeth at which the second gear 60*b* rotated by a certain angle meshes with the second rack member 63 is larger than the number of teeth at which the first gear 60*a* rotated by the same angle meshes with the first rack member 62. Therefore, when the gear portion 60 is rotated about the rotation shaft 61, an upward movement amount of the second rack member 63 (the lock member 63*a*) can be made to be larger than an upward movement amount of the first rack member 62 (the cap member 52).

Third Embodiment

Next, the third embodiment related to the printer 100 will be described. A difference between the present embodiment and the first embodiment is a peripheral structure of the maintenance mechanism MN, and the other configurations are common. Therefore, hereinafter, only a peripheral configuration of the maintenance mechanism MN will be described, and description of the other configurations will be omitted or be made briefly. In addition, the same constituent elements and members as in the first embodiment are given the same reference numerals and are described.

Figure 5A:
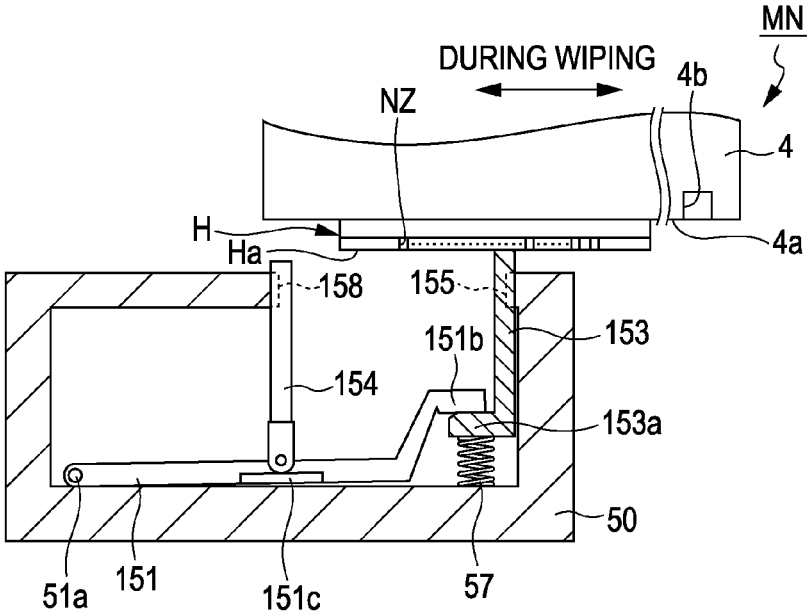
FIGS. 5A and 5B are cross-sectional views illustrating a configuration of a maintenance mechanism according to a third embodiment.
Figure 5B:
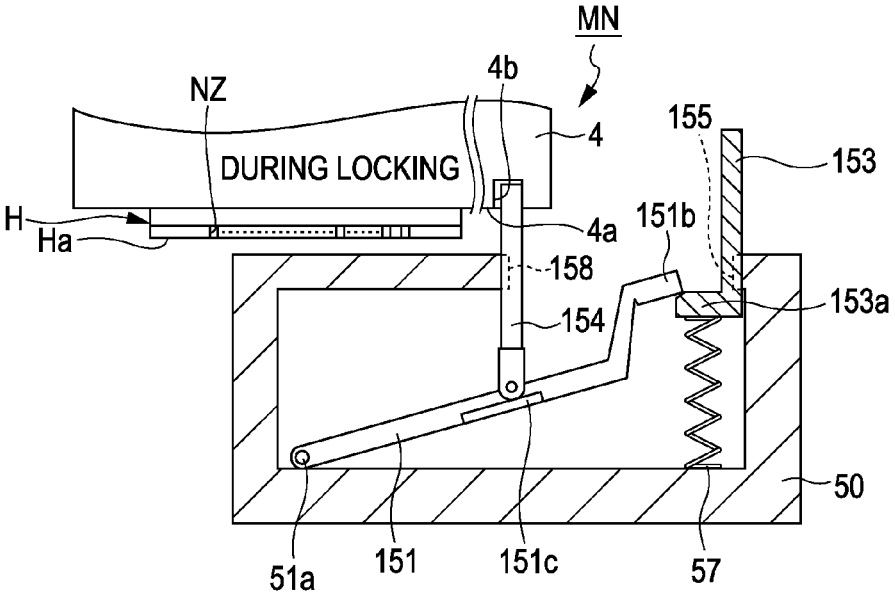

FIGS. 5A and 5B are cross-sectional views illustrating a configuration of a maintenance mechanism MN according to the present embodiment, where FIG. 5A shows a state in which a lock member 154 is slightly moved upward, and FIG. 5B shows a state in which the lock member 154 is completely moved downward. The maintenance mechanism MN according to the present embodiment includes, as shown in FIGS. 5A and 5B, a lever member 151 which moves up and down the lock member 154 and a wiping member 153, and a main body portion 50. In addition, in the present embodiment, the cap member 52 is moved up and down by a driving portion different from that of the lever member 151.

The lever member 151 is installed in the main body portion 50 in a state of being rotatably moved by a driving member (not shown) via a fulcrum 51*a* provided at one end thereof. A lock contact portion (a second portion) 151*c* which comes into contact with the lock member 154 is provided around the fulcrum 51*a* of the lever member 151. A wiping member contact portion (a first portion) 151*b* which comes into contact with the wiping member 153 is provided at the other end of the lever member 151. Specifically, the lever member 151 is rotatably moved with respect to the fulcrum 51*a* so as to lift up the wiping member contact portion 151*b* side as shown in FIG. 5B.

The wiping member contact portion 151*b* is provided at a location more distant from the fulcrum 51*a* than the lock contact portion 151*c*. With this configuration, when the lever member 151 is rotatably moved with respect to the fulcrum 51*a*, an upward movement amount in the wiping member contact portion 151*b* which is distant from the fulcrum 51*a* can be made to be larger than an upward movement amount in the lock contact portion 151*c*. In other words, the lever member 151 realizes a configuration in which movement amounts (lifting amounts) in the wiping member 153 and the lock member 154 are different from each other.

In addition, the wiping member contact portion 151*h* is located at a position more distant upward (in the Z direction) from the bottom surface 50*a* of the main body portion 50 than the fulcrum 51*a* and the lock contact portion 151*c* in a state in which the lever member 151 is installed in the main body portion 50. Thereby, the wiping member contact portion 151*b* can be moved upward to a higher position than the lock contact portion 151*c* when the lever member 51 is rotatably moved. Therefore, as described later, when the lever member 151 is slightly rotated, an upward movement amount of the lock member 154 is suppressed so as to be prevented from coming into contact with the ejecting surface Ha and to move the wiping member 153 to a position which can come into contact with the ejecting surface Ha.

The wiping member 153 is held by a wiping guiding portion 155 of which one end is provided in the inner surface of the main body portion 50. The wiping member 153 can be moved in the vertical direction by the wiping guiding portion 155 without rattling.

The wiping member 153 has a bent portion 153*a* which is bent approximately in an L shape in the lower end part, and the bent portion 153*a* comes into contact with the wiping member contact portion 151*b* of the lever member 151. In addition, a spring member 57 is provided between a lower surface of the bent portion 153*a* and the bottom surface 50*a* of the main body portion 50. Thereby, the wiping member 153 is in a state of being biased upward by the spring member 57.

The lock member 154 is held by a lock guiding portion 158 of which one end side is provided at the inner surface of the main body portion 50. The lock member 154 can be moved by the lock guiding portion 158 in the vertical direction without rattling.

The wiping member 153 is disposed at a position where the front end part thereof can come into contact with the ejecting surface Ha of the head H in a state (refer to FIG. 5A) in which the lever member 151 is slightly rotatably moved with respect to the fulcrum 51*a*. Thereby, the carriage 4 is moved such that the wiping member 153 sweeps away the ejecting surface Ha. As such, the front end of the lock member 154 is located on a lower side than the front end of the wiping member 153 and the ejecting surface Ha in a state in which the lever member 151 is slightly rotatably moved. Therefore, it is possible to prevent the lock member 154 from coming into contact with the ejecting surface Ha in a case of the carriage 4 moves the head H so as to perform a wiping operation on the ejecting surface Ha as well.

On the other hand, when the lever member 151 is rotatably moved with respect to the fulcrum 51*a* and thus a position of the lock contact portion 151*c* is moved to the upper end, the lower end part of the lock member 154 is pushed up, and thus the lock member 154 is guided in the lock guiding portion 158 and is thus moved upward. Thereby, it is possible to insert the front end part of the lock member 154 into the recess portion 4*b* provided in the lower surface 4*a* of the carriage 4 which holds the head H located at the home position (refer to FIG. 5B).

At this time, since the wiping member 153 is at a position spaced apart from the carriage 4, the wiping member 153 does not come into contact with the carriage 4. In addition, a position of the carriage 4 is fixed by the lock member 154 so as to move up and down the cap member 52, thereby preventing occurrence of rattling when the cap member 52 comes into contact with the ejecting surface Ha and to thereby favorably perform the sucking operation for discharging ink from the nozzles NZ.

Fourth Embodiment

Next, the fourth embodiment related to the printer 100 will be described. A difference between the present embodiment and the second embodiment is a peripheral structure of the maintenance mechanism MN, and the other configurations are common. Specifically, the present embodiment is a combination of the configuration of the gear portion 60 related to the second embodiment and the configuration of making lifting amounts of the wiping member and the lock member different from each other, related to the third embodiment. In addition, hereinafter, only a peripheral configuration of the maintenance mechanism MN will be described, and description of the other configurations will be omitted or be made briefly. Further, the same constituent elements and members as in the second and third embodiments are given the same reference numerals and are described.

Figure 6A:
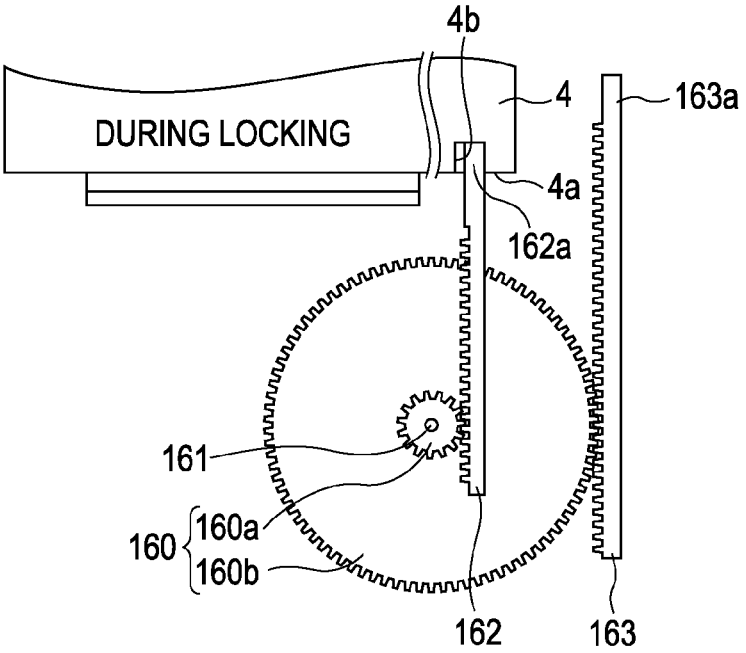
FIGS. 6A and 6B are cross-sectional views illustrating a configuration of a maintenance mechanism according to a fourth embodiment.
Figure 6B:
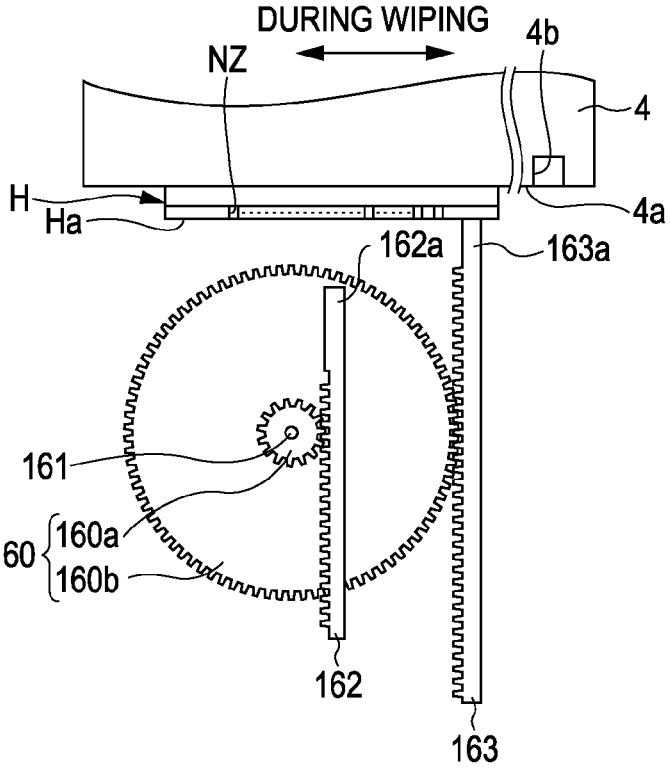

FIGS. 6A and 6B are cross-sectional views illustrating a configuration of a maintenance mechanism MN according to the present embodiment, where FIG. 6A shows a state in which a carriage is locked, and FIG. 6B shows a state in which a wiping process is performed. The maintenance mechanism MN according to the present embodiment includes, as shown in FIGS. 6A and 6B, a gear portion 160 used as a movement member instead of the above-described lever member 51, a first rack member 162, and a second rack member 163. In addition, in the present embodiment, the cap member 52 performs a lifting operation using a driving portion different from the lever member 151.

A first gear 160*a* meshes with the first rack member 162. The first gear 160*a* is rotated in a predetermined direction (for example, a counterclockwise direction in FIG. 6A) such that a lock member 162*a* provided at one end of the first rack member 162 is inserted into the recess portion 4*b* provided in the bottom of the carriage 4 and thus the first rack member 162 is engaged with the carriage 4.

In addition, a second gear 160*b* is meshed with the second rack member 163. The second gear 160*b* is rotated in a predetermined direction (for example, a counterclockwise direction in FIG. 6B) such that a wiping member 163*a* provided at one end side of the second rack member 163 comes into contact with the ejecting surface Ha of the head H. The carriage 4 and the wiping member 163*a* are relatively moved in this state, and thereby it is possible to perform a wiping process in which the wiping member 163*a* sweeps away the ejecting surface Ha.

With the configuration according to the present embodiment, in the same manner as in the configuration according to the third embodiment, when the gear portion 160 is rotated about the rotation shaft 161, it is possible to make an upward movement amount of the first rack member 162 (the lock member 162*a*) different from an upward movement amount of the second rack member 163 (the wiping member 163*a*).

In addition, the invention is not limited to the above-described embodiments, and may be appropriately changed in the scope without departing from the spirit of the invention.

For example, although, in the above-described embodiments, the lever member or the gear portion has been exemplified as a movement member for making lifting amounts of the cap member or the wiping member and the lock member, the invention is not limited thereto. For example, a configuration may be employed in which, for example, a plurality of gears are disposed in multiple stages instead of composite gears as a movement member, and a reduction gear ratio is used, thereby making lifting amounts of the cap member or the wiping member and the lock member different.

In addition, although, in the present embodiment, a case where the liquid ejecting apparatus is the printer 100 has been described as an example, the invention is not limited thereto. Apparatuses such as a copier and a facsimile may be employed.

Further, as the liquid ejecting apparatus, a recording apparatus which ejects fluids other than ink may be used. The invention is applicable to a variety of recording apparatus having a recording head or the like which ejects, for example, a very small amount of droplet. In addition, the droplet refers to a state of being liquid ejected from the recording apparatus, and also include droplet leaving a trail in a granular, tear, or filamentous form. Further, the liquid described herein may be a material which can be ejected by a recording apparatus. For example, the liquid may include a substance which is in a liquid phase, a flow regime such as a liquid body, sol, or gel water with high or low viscosity, and other inorganic solvent, organic solvent, a solution, a liquid resin, or a liquid metal (metallic melt), and, further includes, in addition to the liquid as one state of a substance, a substance in which functional material particles formed from pigments or metal particles are melt, dispersed or mixed in a solvent. In addition, a representative example of the liquid may be ink (UV curable ink) as described in the embodiments, but ink may not be of UV curable type as long as the ink has high viscosity. Further, the medium M may include paper or a plastic film such as a vinyl chloride based film as well as functional paper which is thin and thermally expands, a substrate, a metal plate, or the like.

The entire disclosure of Japanese Patent Application No. 2012-044504, filed Feb. 29, 2012, is expressly incorporated by reference herein.

What is claimed is:

1. A liquid ejecting apparatus comprising:

an ejecting head that has a nozzle for ejecting liquid onto a medium;

a carriage that holds the ejecting head and can be moved in a predetermined direction;

a maintenance member that can be moved up and down with respect to a nozzle formation surface where the nozzle is formed in the ejecting head, and performs maintenance on the nozzle formation surface;

a lock member that can be moved up and down with respect to the carriage and fixes a position of the carriage; and a movement member that directly contacts the lock member and the maintenance member and that moves the lock member and the maintenance member such that a lifting amount of the lock member is different from a lifting amount of the maintenance member, wherein the movement member is a lever member which is rotated with respect to a predetermined fulcrum and of which a first portion which comes into contact with the maintenance member and a second portion which comes into contact with the lock member have different distances from the fulcrum.

2. The liquid ejecting apparatus according to claim 1, wherein the maintenance member is a wiping member which sweeps away the nozzle formation surface, and wherein the first portion of the movement member is more distant from the fulcrum than the second portion thereof.

3. The liquid ejecting apparatus according to claim 1, wherein the maintenance member is a cap member which sweeps away the nozzle formation surface, and wherein the second portion of the movement member is more distant from the fulcrum than the first portion thereof.

4. A liquid ejecting apparatus comprising:

an ejecting head that has a nozzle for ejecting liquid onto a medium;

a carriage that holds the ejecting head and can be moved in a predetermined direction;

a maintenance member that can be moved up and down with respect to a nozzle formation surface where the nozzle is formed in the ejecting head, and performs maintenance on the nozzle formation surface;

a lock member that directly contacts the lock member and the maintenance member and that can be moved up and down with respect to the carriage and fixes a position of the carriage; and a movement member that moves the lock member and the maintenance member such that a lifting amount of the lock member is different from a lifting amount of the maintenance member, wherein the movement member is a composite gear which is rotated with respect to a predetermined rotation axis and of which a first gear which comes into contact with the maintenance member and a second gear which comes into contact with the lock member have different shapes.

5. The liquid ejecting apparatus according to claim 4, wherein the maintenance member is a wiping member which sweeps away the nozzle formation surface, and wherein the first gear of the composite gear has an outer diameter larger than the second gear thereof.

6. The liquid ejecting apparatus according to claim 4, wherein the maintenance member is a cap member which comes into contact with the nozzle formation surface, and wherein the second gear of the composite gear has an outer diameter larger than the first gear thereof.

* * * * *